US009676453B2

(12) United States Patent
Janik

(10) Patent No.: US 9,676,453 B2
(45) Date of Patent: Jun. 13, 2017

(54) HYBRID WINCH WITH CONTROLLED RELEASE AND TORQUE IMPULSE GENERATION CONTROL FOR ANCHOR HANDLING OFFSHORE

(71) Applicant: John Bradford Janik, Houston, TX (US)

(72) Inventor: John Bradford Janik, Houston, TX (US)

(73) Assignee: Electronic Power Design, Inc., Houston, TX (US)

( * ) Notice: Subject to any disclaimer, the term of this patent is extended or adjusted under 35 U.S.C. 154(b) by 36 days.

(21) Appl. No.: 14/560,171

(22) Filed: Dec. 4, 2014

(65) Prior Publication Data

US 2016/0114862 A1 Apr. 28, 2016

Related U.S. Application Data

(60) Provisional application No. 62/069,728, filed on Oct. 28, 2014.

(51) Int. Cl.

| | |
|---|---|
| ***B66D 1/60*** | (2006.01) |
| ***B66D 1/12*** | (2006.01) |
| ***B63B 21/50*** | (2006.01) |
| ***B66D 1/50*** | (2006.01) |
| *B63J 99/00* | (2009.01) |

(52) U.S. Cl.

CPC ..... *B63B 21/50* (2013.01); *B66D 1/12* (2013.01); *B66D 1/505* (2013.01); *B66D 1/60* (2013.01); *B63B 2021/505* (2013.01); *B63B 2708/02* (2013.01); *B63J 2099/006* (2013.01); *B66D 2700/0141* (2013.01)

(58) Field of Classification Search

CPC ..... B63B 21/50; B63B 2708/02; B63B 2021/505; B66D 1/12; B66D 1/505; B66D 1/60; B66D 2700/0141; B63J 2099/006

See application file for complete search history.

(56) References Cited

U.S. PATENT DOCUMENTS

| | | | | |
|---|---|---|---|---|
| 7,311,297 | B1 * | 12/2007 | Bradshaw | B66D 3/18 254/271 |
| 2005/0109256 | A1 * | 5/2005 | Zaman | B63B 35/4413 114/230.23 |
| 2011/0100279 | A1 * | 5/2011 | Roodenburg | B63B 39/00 114/122 |

* cited by examiner

*Primary Examiner* — Redhwan K Mawari
*Assistant Examiner* — Rodney P King
(74) *Attorney, Agent, or Firm* — G. Michael Roebuck

(57) ABSTRACT

A hybrid winch system for use with an anchor handling vessel is disclosed that includes but is not limited to an electric winch mountable on the anchor handling vessel, an electric generator for providing generated power to the electric winch, a battery for providing stored power to the electric winch, an anchor cable wound around the electric winch and passing over a roller drum for guiding the anchor cable, an anchor attached to a distal end of the anchor cable and a winch controller for selectively applying the generated power and the stored power to the electric winch. The winch controller is configured to provide the stored power to the electric winch for controlled release of the anchor cable in the case of loss of the generated power.

19 Claims, 5 Drawing Sheets

HYBRID WINCH WITH CONTROLLED RELEASE AND TORQUE IMPULSE GENERATION CONTROL FOR ANCHOR HANDLING OFFSHORE

CROSS REFERENCE TO RELATED APPLICATIONS

This application claims priority to U.S. Provisional Application 62/069,728, filed Oct. 28, 2014 which is hereby incorporated by reference.

BACKGROUND OF THE DISCLOSURE

Technical Field of the Disclosure

The present embodiment is related in general to anchor handling winches, and in particular to a hybrid winch with torque impulse generation control for anchor handling in offshore semisubmersible oil rigs.

Description of the Related Art

Floating oil rigs are constructed on floating platforms. Some of these platforms are anchored to the sea bed. The floating platforms are tethered to the anchors with cables. One of the most dangerous jobs at sea is anchoring the floating oil rig platforms. These tethering cables are up to three inches in diameter and can be up to three miles long. Anchor handling vessels set the anchors in the sea bed and winch the end of the tethering cable connected to the anchor to create tension on the tethering cable and to set the anchor in the seabed. The anchor handling vessel pulls on the anchor end of the tethering cable to set the anchor.

The anchor handling vessel resists the pull of the tension placed on the anchor cable with the vessel's propulsion system, typically a diesel engine. If the vessel's propulsion system fails, the pull of the anchor cable can pull the vessel underwater and submerge the vessel, risking the lives of the crew aboard the anchor handling vessel. In addition, if the vessel propulsion system fails, tension on the tethering cable can pull the anchor handling vessel backwards without the benefit of steerage, or the benefit of the active resistance of the vessel propulsion system.

Recent advancements in the art disclose a power-assisted winch including a control system for detecting the amount of rotational turning force or torque supplied by a manual input drive to the winch drum, which supplies a rotational turning force or torque from a motor to the winch drum and controls the amount of torque supplied by the motor to the winch drum as a function of the amount of turning force or torque supplied by the manual drive. The function may be a fixed predetermined ratio or it may vary depending upon the level of turning force or torque supplied by the manual input drive. A torque sensor may be utilized to detect the level of manual torque, and a control apparatus will adjust the amount of torque supplied by the motor to the winch drum as required. However, the primary operation of the winch is manual, although it is assisted by power. In the case of semisubmersible oil rigs, manual operation is not feasible due to the heavy duty nature of anchor handling operations.

Floating oil rigs are constructed on floating platforms that are anchored to the sea bed. The floating platforms are tethered to the anchors with cables. One of the most dangerous jobs at sea is anchoring the floating oil rig platforms. These tethering cables are up to 3 inches in diameter and can be up to 3 miles long. Anchoring vessels set the anchors in the sea bed and winch the end of the tethering cable connected to the anchor to create tension on the cable and to set the anchor in the seabed. The anchoring vessel pulls on the anchor end of the tethering cable to set the anchor. The anchoring vessel resists the pull of the tension placed on the anchor cable with the vessel's propulsion system, typically a diesel engine. If the vessel's propulsion system fails, the pull of the anchor cable can submerge the vessel, risking the lives of the crew about the anchoring vessel. In addition, if the vessel propulsion system fails, tension on the tethering cable can pull the anchoring vessel backwards without the benefit steerage in the reverse direction or the benefit of active resistance of the vessel propulsion system.

SUMMARY OF THE INVENTION

An illustrative embodiment of the present invention provides a hybrid winch system for use with an anchor handling vessel and that provides torque impulse generation control for anchor handling of semi-submersible floating oil rigs.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE INVENTION

Figure 1:
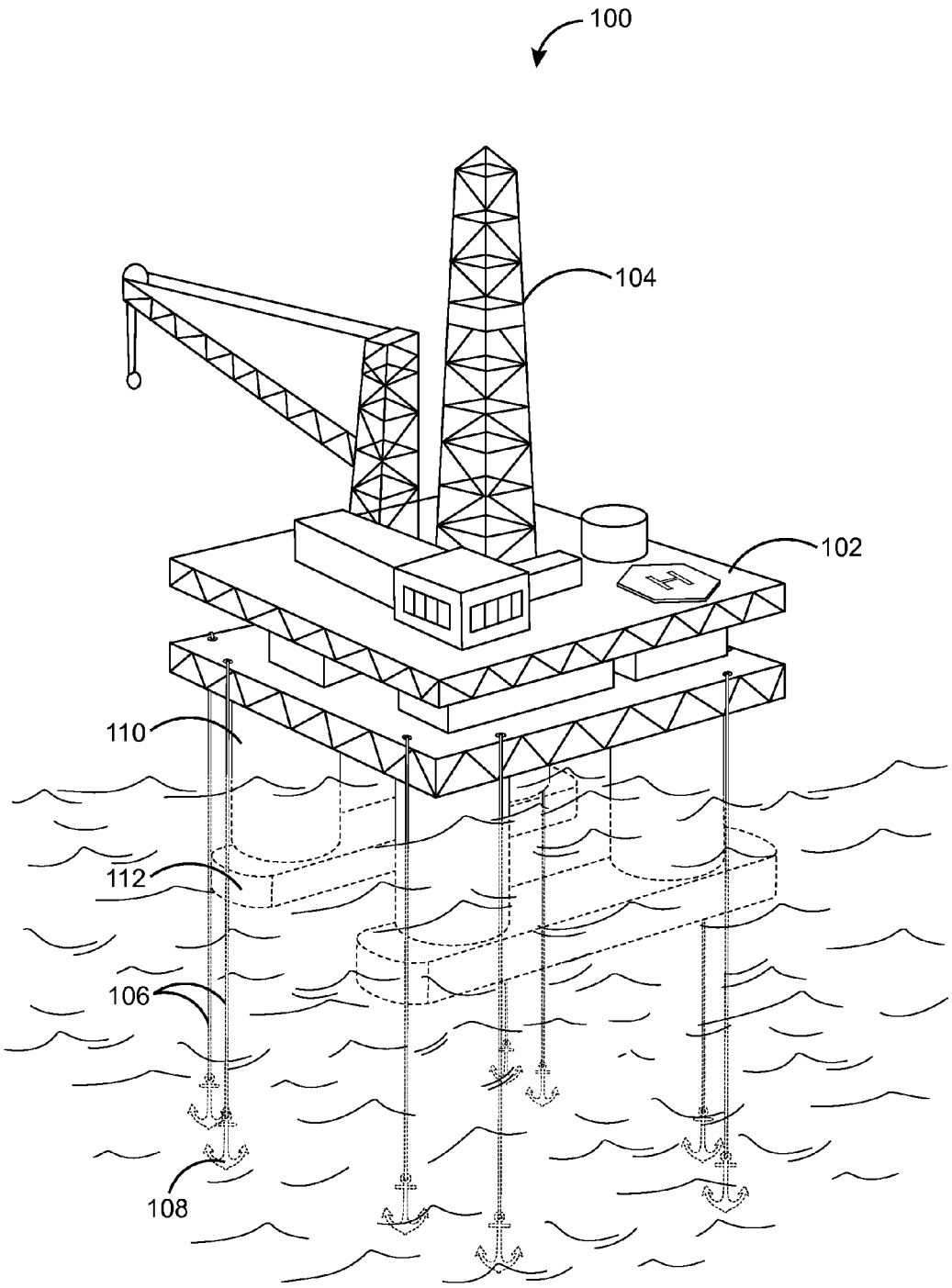
FIG. 1 is a schematic representation of a floating oil rig anchored to a seabed in accordance with an illustrative embodiment of the present invention.

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

In a particular illustrative embodiment, a hybrid winch system is disclosed for use with an anchor handling vessel, the system including but not limited to an electric winch mountable on the anchor handling vessel; an electric generator for providing generated power to the electric winch; a battery for providing stored power to the electric winch; an anchor cable wound around the electric winch and passing over a roller drum for guiding the anchor cable; an anchor attached to a distal end of the anchor cable; and a winch controller for selectively applying the generated power and the stored power to the electric winch; whereby the winch controller being configured to provide the stored power to the electric winch for controlled release of the anchor cable in case of loss of the generated power. In another illustrative embodiment of the hybrid winch system, the winch controller further includes but is not limited to a torque control processor; an input/output port for connecting the electric winch to the winch controller; and a non-transitory computer readable medium in data communication with the torque control processor and a computer program having executable instructions to determine if the electric generator power failed; measure tension on the anchor cable attached to the electric winch and the anchor when the electric generator power has failed; and adjust torque of the electric winch pulling the anchor cable for controlled release thereof by providing stored power from the battery. In another illustrative embodiment of the hybrid winch system, the computer program further includes but is not limited to executable instructions to determine if an acceptable stability parameter for the anchor handling vessel is exceeded; and adjust the torque of the electric winch until acceptable stability parameter for the anchor handling vessel is not exceeded. In another illustrative embodiment of the hybrid winch system, the computer program further comprises executable instructions to determine if a set anchor mode of the winch controller is turned on; add controlled torque to the electric winch when the set anchor mode is turned on by providing stored power from the battery; measure tension on the anchor cable and adjust the torque of the electric winch; and determine if the anchor is set in the sea bed. An anchor is set in the sea bed when a predetermined tension is exceeded on the anchor cable.

In another illustrative embodiment of the hybrid winch system, the electric winch is driven by an electric motor. In another illustrative embodiment of the hybrid winch system, the electric generator is powered by an engine of the anchor handling vessel. In another illustrative embodiment of the hybrid winch system, the winch controller further includes but is not limited the battery provides backup power for the electric winch if the electric generator loses power. In another illustrative embodiment of the hybrid winch system the battery provides extra horse power for setting the anchor in the sea bed off shore for stabilizing a floating oil rig.

In another illustrative embodiment, a hybrid winch system for use with an anchor handling vessel is disclosed, the system including but not limited to an electric winch mountable on the anchor handling vessel; an electric generator for providing generated power to the electric winch; a battery for providing stored power to the electric winch; an anchor cable wound around the electric winch and passing over a roller drum for guiding the anchor cable; an anchor attached to a distal end of the anchor cable; and a winch controller including but not limited to a torque control processor; an input/output port for connecting the electric winch to the winch controller; and a non-transitory computer readable medium in data communication with the torque control processor and comprising a computer program having executable instructions to selectively apply the generated power and the stored power to the electric winch; whereby the winch controller being configured to provide the stored power to the electric winch for controlled release of tension on the anchor cable in case of loss of the generated power.

In another illustrative embodiment of the hybrid winch system, the computer program includes but is not limited to executable instructions to determine if the electric generator power failed; measure tension on the anchor cable attached to the electric winch and the anchor when the electric generator power has failed; adjust torque of the electric winch pulling the anchor cable for controlled release thereof by providing stored power from the battery; determine if an acceptable stability parameter for the anchor handling vessel is exceed; and adjust the torque of the electric winch until the acceptable stability parameter for the anchor handling vessel is not exceeded. In another embodiment the computer program includes but is not limited to instructions to determine if the tension on the anchor cable is less than the buoyancy of the anchor handling vessel. In another embodiment the computer program includes but is not limited to instructions to determine if the tension on the anchor cable is less than the buoyancy of the anchor handling vessel. The torque is dynamically and automatically by the computer program in the torque control processor to maintain the vessel within the acceptable stability parameters. When an acceptable stability parameter is exceeded a computer program on the torque processor dynamically and automatically adjusts torque on the winch to maintain the vessel within the acceptable stability parameters. In a particular embodiment, the computer program determines if the maximum astern pitch angle is exceeded and reduces torque on the winch and tension on the anchor chain or cable to reduce the astern pitch angle. The astern pitch angel is negative when the back of the vessel is lower than the front of the vessel. The torque on the winch is automatically and dynamically adjusted to relieve tension on the anchor chain and cable wound on the winch to prevent the tension on the anchor cable from pulling the back of the vessel underwater. This automatic adjustment of the torque to relieve the tension on the anchor cable is particularly useful when vessel power is lost.

In another illustrative embodiment of the hybrid winch system, the computer program further comprises executable instructions to determine if a set anchor mode of the winch controller is turned on; add controlled torque to the electric winch when the set anchor mode is turned on by providing stored power from the battery; measure tension on the anchor cable and adjust the torque of the electric winch; and determine if the anchor is set in the sea bed. An anchor is determined to be set when, during anchor setting operations, a tension on the anchor cable exceeds a predetermined anchor set value stored in the non-transitory computer readable medium. In a particular embodiment, the anchor set value for tension is determined during prior anchor setting operations wherein the anchor set value tension for a particular anchor and anchor cable type and length is learned by a neural network and stored in the non-transitory computer readable medium. In another particular embodiment, the anchor set value for tension is determined during prior anchor setting operations wherein the anchor set value tension given for a particular anchor and anchor cable type and length and stored in the non-transitory computer readable medium.

In another illustrative embodiment of the hybrid winch system, the electric winch is driven by a hydraulic motor. In another illustrative embodiment of the hybrid winch system, the electric generator is powered by an engine of the anchor handling vessel. In another illustrative embodiment of the hybrid winch system, the battery provides backup power for the electric winch if the electric generator loses power. In another illustrative embodiment of the hybrid winch system, the battery provides extra horse power for setting the anchor in the sea bed off shore for stabilizing a floating oil rig.

In another illustrative embodiment of the invention, a method is disclosed for controlling a winch system associated with an anchor handling vessel by executing a computer program stored in a non-transitory computer readable medium of a winch controller connected to an electric winch thereof, the computer program having executable instructions which when executed performs the steps of determining at the winch controller if an electric generator power has failed; measuring the tension on an anchor cable attached to the electric winch and an anchor when the electric generator power has failed; adjusting torque of the electric winch pulling the anchor cable in a controlled release thereof by providing stored power from a battery; determining at the winch controller if the tension on the anchor cable is greater than a buoyancy of the anchor handling vessel; and lowering the torque on the electric winch until the tension on the anchor cable is less than the buoyancy of the anchor handling vessel. In another illustrative embodiment of the method for controlling the winch system, the method further includes but is not limited to determining at the winch controller if a set anchor mode is turned on; adding controlled torque to the electric winch when the set anchor mode is turned on by providing stored power from the battery; (a) measuring the tension on the anchor cable and adjusting the torque of the electric winch; (b) determining if the anchor is set in the sea bed; and (c) returning to step (a) if the anchor is not set. In another illustrative embodiment of the method the electric generator is powered by an engine of the anchor handling vessel. In another illustrative embodiment of the method the battery provides backup power for the electric winch if the electric generator loses power. In another illustrative embodiment of the method the battery provides extra horse power for setting the anchor in the sea bed off shore for stabilizing a floating oil rig.

Anchor handling involves a number of special marine operations. The high tensions experienced in anchor cables and anchor handling chains and wires may cause high heeling moments and may cause high transverse and/or astern (longitudinal) movements of the anchor handling vessel. The vessel may also be affected by high hauling speed on the anchor handling winch or as result of any loss of bollard pull. Bollard pull is a conventional measure of the pulling (or towing) power of a watercraft such as sea going vessel. The anchor handling vessel may be pulled astern at speed by the tension in a heavy anchor arrangement. Any simultaneous loss of thrust, for any reason, on the anchor handling vessel may lead to rotation of the anchor handling vessel which would lead to considerable extra transverse and astern forces. In extreme cases a transverse or longitudinal motion can cause an anchor handling vessel to capsize. Environmental conditions can also influence the anchor handling vessel operations. For these reasons the vessel's transverse and longitudinal stability are closely monitored. In a particular embodiment, the vessel's transverse and longitudinal stability are monitored and the torque exerted by the hybrid winch is automatically and dynamically adjusted to maintain the vessel's transverse and longitudinal stability within the acceptable stability parameters.

In a particular illustrative embodiment, acceptable stability parameters, that is, vertical (longitudinal) forces and tensions and transverse (horizontal) forces and tensions to which the vessel can be safely exposed are stored in the non-transitory computer readable medium. The winch torque can be automatically and dynamically adjusted, that is, increased and decreased under control of the torque processor to offset these transverse and longitudinal forces and tensions which cause the vessel to exceed one or more of the acceptable stability parameters. These acceptable stability parameters are stored in the non-transitory computer readable medium for each particular vessel and vessel configuration, intact and damaged. A transverse stability curve and a table of the tension/forces which give the maximum acceptable heeling moment are included in the acceptable stability parameters. A longitudinal stability curve and a table of the tension/forces which give the maximum acceptable pitching moment are also calculated and included in the acceptable stability parameters. Hydrostatic calculation computer programs run on the torque processor to determine the acceptable stability parameters based on the vessel's intact configuration. The longitudinal stability curve and the transverse stability curve and the acceptable stability parameters are calculated for intact stability, damage stability and different loading conditions. Loading and the associated stability of the vessel can be changed from the initial stability by changes in loading and damage, thus the acceptable stability parameters are recalculated as the loading changes and when damage occurs to the vessel.

Thus, in a particular embodiment, the vessel is monitored for damage such as flooding and flooding location to determine the effect of the damage, i.e., flooding in this example, on the vessels longitudinal and transverse stability and the acceptable stability parameters recalculated and applied to a current condition and anchor handling operation of the anchor handling vessel. In another particular, the vessel is monitored for loading conditions and loading location to determine the effect of the loading on the vessels longitudinal and transverse stability and the acceptable stability parameters recalculated and applied to a current loading and anchor handling operation of the anchor handling vessel. An initial stability is calculated and acceptable stability parameters calculated for the vessel. As the vessel progresses during operations, the loading can change due to fuel tanks being emptied by expended fuel, water being used by the crew for food and showers, ice on the deck, heavy cargo on the deck, emptying fluid tanks low in the hull and liquid free surfaces. These conditions are monitored and the acceptable longitudinal and transverse stability parameters recalculated and stored in the non-transitory computer readable medium.

In a particular illustrative embodiment, the acceptable stability parameters are calculated using a computer program on the torque control processor. The acceptable stability parameters are calculated based on stability calculations showing maximum acceptable tension in an anchor cable, including transverse and longitudinal, astern forces, that can be accepted in order for the vessel's maximum heeling (transverse stability) and maximum pitch angle (astern or longitudinal stability) to be limited to a safe angle. In another particular embodiment, the acceptable stability parameters are learned by a neural network during anchoring operations and stored in the non-transitory computer readable medium in data communication with the torque control processor. In another particular embodiment, the neural network dynamically controls the torque exerted by the winch to adjust transverse and longitudinal to stay within the acceptable stability parameters. The acceptable stability parameters include but are not limited to a maximum acceptable heeling angle and a maximum acceptable pitch angle. In another particular embodiment, the maximum acceptable heeling angle is a heeling angle equivalent to a transverse stability value, GZT value equal to 50% of GZ max. In another particular embodiment, the maximum acceptable pitch angle is 50% of a maximum pitching angle equivalent to a longitudinal stability value, GZL. In another particular embodiment a maximum heeling angel is the angle of flooding of the work deck—i.e. the angle which results in water on the vessel's working deck when the working deck is flat. In another particular embodiment the maximum heeling angle is about 12-15 degrees. In another particular embodiment the vessel's maximum pitching angle is about 2-5 degrees.

The acceptable stability parameters and stability calculations are performed to determine the maximum force from the anchor cable, acting down at the winch at a stern roller and transversely to the outer pins, which would be acceptable without taking the vessel beyond the angles defined in the acceptable stability parameters. The heeling moment based on transverse bollard pull is also be calculated or learned in the neural network on the torque processor computer and allowed for. Maritime Anchor Handling guidelines suggest that the vertical component is to be taken as the distance (vertically) from the deck at the tow pins to the center of the stern thruster or propeller shaft, whichever is the lower. The vessel information needed for the calculations determining the acceptable stability parameters can be obtained from the naval architect who designed the vessel. The maximum force and associated tension in the anchor wire/chain as well as the point where the lateral force is assumed to be applied (towing pin/stern roller) is monitored and the torque exerted by the winch adjusted to stay within the acceptable stability parameters. The force exerted by the tension on the anchor cable rolled on the winch can have an effect on both the longitudinal and transverse stability. Thus, both the longitudinal and transverse acceptable stability parameters are monitored and the winch torque automatically and dynamically adjusted when one of the longitudinal and transverse acceptable stability parameters are exceeded. The maximum vertical pull on the wire/chain must not be such as to exceed those limits given above or to exceed the safe working load (SWL) of the roller. Safe Working Load (SWL) sometimes stated as the Normal Working Load (NWL) is the load that a piece of lifting equipment, lifting device or accessory can safely utilize to lift, suspend, or lower a mass without fear of breaking. This will add to listing moments and stem trim; this type of vessel usually suffers reduction of stability and the deck edge is immersed earlier as the stem trim increases. A flooded deck at this point from a breaking wave or tension on the anchor cable can also cause a temporary reduction in stability.

FIG. 1 is a schematic representation of a floating oil rig 100 anchored to a sea bed in accordance with an illustrative embodiment of the present invention. The floating oil rig 100 has a floating semi-submersible platform 102 supporting drilling and production infrastructure 104. Each corner of the floating semi-submersible platform 102 is tethered to two anchor cables 106 which are each anchored to the sea bed with an anchor 108. The floating semisubmersible platform 102 is supported by structural columns 110 that have ballasted, watertight pontoons 112 located below the ocean surface. The floating oil rig 100 is towed to location and anchored to the sea bed by an anchor handling vessel 114 (See FIG. 2).

Figure 2:
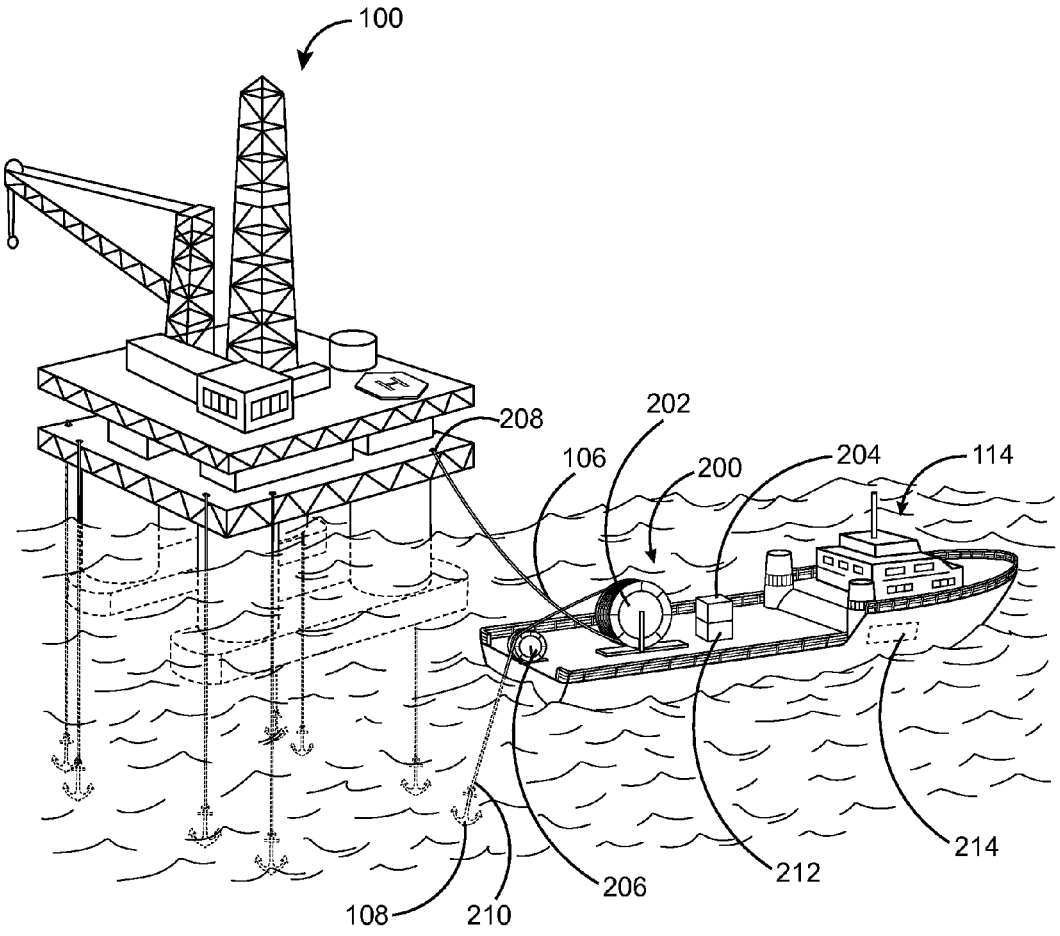
FIG. 2 is a schematic view of an anchor handling vessel installed with a hybrid winch system in accordance with another illustrative embodiment of the present invention.

FIG. 2 is a schematic view of an anchor handling vessel 114 installed with a hybrid winch system 200 in accordance with a particular illustrative embodiment of the present invention. The hybrid winch system 200 provides torque impulse generation control for anchor handling of semisubmersible floating oil rigs 100. The hybrid winch system 200 comprises an electric winch 202 and a winch controller 204 mounted on the anchor handling vessel 114. The hybrid winch system 200 further comprises an anchor cable 106 wound around the electric winch 202 and which passes over a roller drum 206 for guiding the anchor cable 106. A proximal end 208 of the anchor cable 106 is attached to the semisubmersible floating oil rig 100 and a distal end 210 of the anchor cable 106 is attached to an anchor 108 for securing to the sea bed.

In a particular illustrative embodiment, the hybrid winch system 200 has two power supplies, an electric generator 212 for providing generated power to the electric winch 202 and a battery 214 for providing stored power to the electric winch 202. The electric generator 212 is powered by a diesel engine on the anchor handling vessel 114. The battery 214 acts as a backup power source when the engine on the anchor handling vessel 114 fails. The winch controller 204 operates by selectively applying the generated power from the electric generator 212 and the stored power from the battery 214 to the electric winch 202 according to the power needs.

Figure 3:
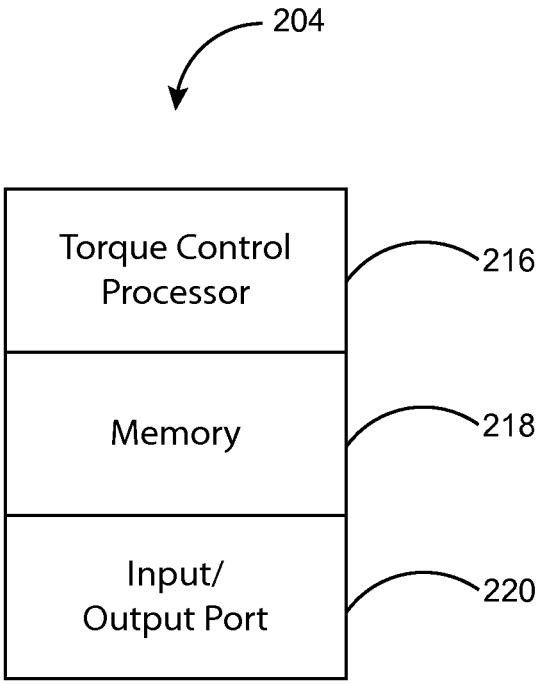
FIG. 3 is a block diagram of a winch controller for the hybrid winch system in accordance with another illustrative embodiment of the present invention.

Referring to FIG. 3, a block diagram of the winch controller 204 for the hybrid winch system 200 in accordance with an illustrative embodiment of the present invention is illustrated. The winch controller 204 senses the state of the power input to the electric winch 202 and dynamically controls the torque thereof. The winch controller 204 includes but is not limited to a torque control processor 216, an input/output port 220 for connecting the electric winch 202 to the winch controller 204, and a non-transitory computer readable medium memory 218 in data communication with the torque control processor 216. Data communication is used in this specification to indicate data flowing between devices that are in data communication.

A computer program having executable instructions is stored in the non-transitory computer readable medium 218. The computer program automatically and dynamically performs a controlled release of the anchor cable 106 on failure of the engine of the anchor handling vessel 114 as illustrated in the flowchart in FIG. 4. The torque control processor 216 runs the computer program to determine if the electric generator 212 power failed, measure tension on the anchor cable 106 attached to the electric winch 202 when the electric generator 212 power has failed, and adjusts the torque of the electric winch 202 for controlled release of the anchor cable 106 by providing stored power from the battery 214. The controlled release is performed by applying variable torque to the winch thereby creating variable tension on the anchor cable. This controlled release does not allow the anchor cable to freewheel from the winch. The controlled release prevents the anchor cable from pulling the vessel underwater. The controlled release substantially reduces the occurrence of anchor cable cutting to save a vessel and its crew from being pulled underwater when vessel power is lost. The computer program also automatically performs a controlled torque profile program when setting an anchor in the sea bed as illustrated in the flowchart in FIG. 5. The torque control processor 216 runs the computer program to determine if a set anchor mode of the winch controller 204 is turned on, add controlled torque to the electric winch 202 when the set anchor mode is turned on by providing stored power from the battery 214, determine if the anchor 108 is set in the sea bed, and measure tension on the anchor cable 106 and adjust the torque of the electric winch 202 until the anchor 108 is set.

Figure 4:
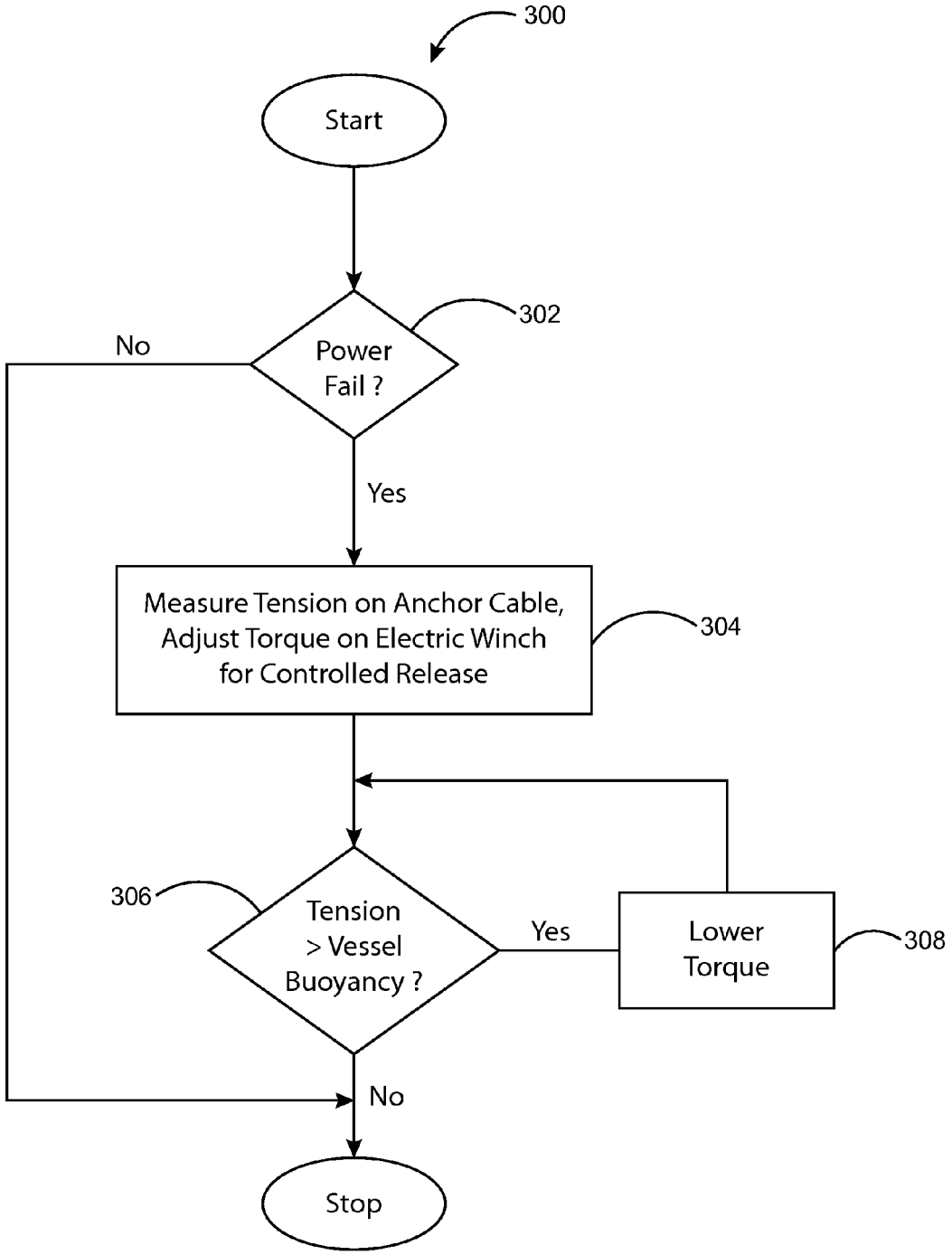
FIGS. 4-5 depict flowcharts illustrating illustrative embodiments of methods for using another illustrative embodiment of the invention.

FIG. 4 depicts a flowchart 300 illustrating a particular embodiment of a method for using the hybrid winch system 200. As shown in FIG. 4, in an illustrative embodiment a controlled release method is performed at the winch controller 204 by controlling the electric winch 202. The torque control processor 216 of the winch controller 204 executes the computer program stored in the non-transitory computer readable medium 218. The computer program determines whether there has been a power failure in the engine of the anchor handling vessel 114 as shown at block 302. Power failure in the engine causes the electric generator 212 to lose power. As a result, the electric winch 202 stops working and may pull the vessel 114 under water due to unregulated tension in the anchor cable 106.

If the anchor handling vessel 114 loses power, the computer program measures the tension on the anchor cable 106 and adjusts the torque of the electric winch 202 to perform a controlled release of the anchor cable 106 by providing backup stored power from the battery 214 as shown at block 304. The computer program further determines whether the tension on the anchor cable 106 is greater than an acceptable stability parameters of the anchor handling vessel 114 as shown at block 306. If the tension on the anchor cable 106 is greater than the buoyancy of the anchor handling vessel 114, the computer program proceeds to lower the torque on the electric winch 202 until the tension on the anchor cable 106 is less than the buoyancy of the anchor handling vessel 114 as shown at block 308. The buoyancy of the vessel can be determined by a predetermined tension setting in the amount of tension that can be safely applied to the anchor cable without submerging the deck of the vessel. In an alternative embodiment, the buoyancy can be determined by a change in the draft depth of the vessel exceeding a safe level. In a particular embodiment the tension and torque are dynamically and automatically controlled to maintain the vessel within the acceptable stability parameters.

Figure 5:
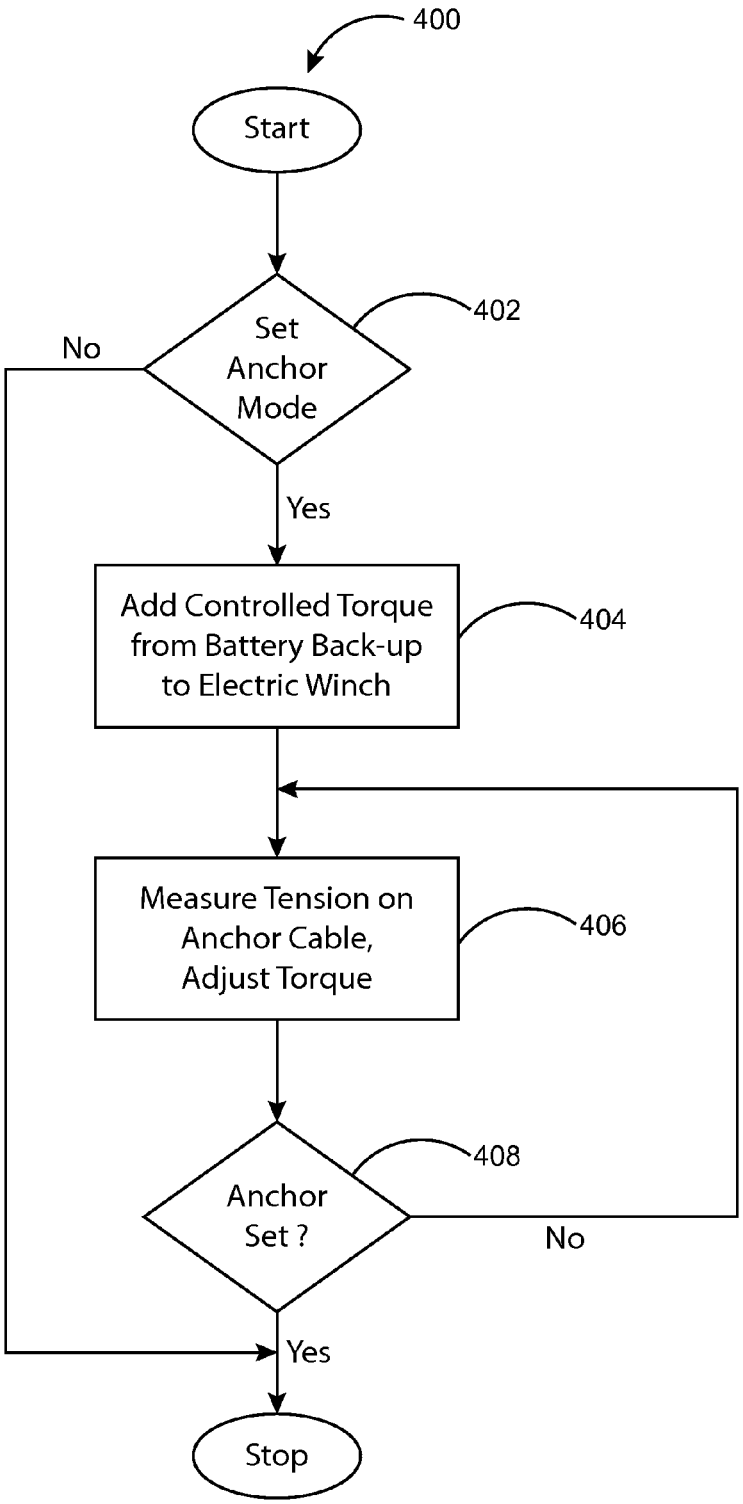

Turning to FIG. 5, another flowchart 400 illustrating a particular embodiment of a method for using the hybrid winch system 200 of the present invention is depicted. As shown in the flow chart in FIG. 5, the electric storage battery 214 provides additional horse power to the electric winch 202 for providing extra pull when needed for setting the anchor 108 in the sea bed off shore for stabilizing the floating oil rig 100. The computer program determines whether a set anchor mode is turned on at the winch controller 204 as shown at block 402. If the set anchor mode is turned on, the computer program proceeds to add controlled torque to the electric winch 202 using the stored power from the battery 214 to add horse power as shown at block 404. The computer program measures the tension on the anchor cable 106 and adjusts the torque of the electric winch 202 accordingly as shown at block 406. The computer program further measures the tension on the anchor cable and determines whether the anchor 108 is set in the sea bed as shown at block 408. The computer program continues to measure the tension on the anchor cable 106 and adjust the torque of the electric winch 202 until the anchor 108 is properly set in the sea bed.

Different controlled torque profiles are stored in the non-transitory computer readable medium and are selected based on the stage of deployment of the anchor 108 and the anchor's engagement with the sea bed. A torque profile define a torque verses time relationship and a tension versus time for applying torque to an anchor cable wound on the winch while setting an anchor during anchor handling operations. A first set of torque profiles for the hybrid winch system 200 are stored in the non-transitory computer readable medium and are selected to perform removing anchors 108 from the sea bed. A second set of torque profiles for the hybrid winch system 200 are stored in the non-transitory computer readable medium and are selected to perform setting anchors 108 in the sea bed. A third set of torque profiles are stored in the non-transitory computer readable medium and are selected to perform controlled release of the anchor cable during an engine failure. In one embodiment of the present system, a neural network computer program is provided to learn a successful torque profile for removing an anchor 108 from the seabed. In another embodiment of the present system, a neural network computer program is provided to learn a successful torque profile for setting an anchor 108 in the seabed. In one embodiment, the hybrid winch system 200 includes but is not limited to a hydraulic motor and/or an electric motor to drive the electric winch 202 for controlling the tension on the anchor cable 106 during anchoring. In one particular embodiment of the invention, the hybrid winch system 200 includes but is not limited to a hydraulic engine and/or a diesel engine to run the electric generator 212.

In another particular embodiment, the torque profiles are dynamically recalculated for changes in the acceptable stability parameters for longitudinal and transverse stability. Changes in the acceptable stability parameters can occur to changes in loading and damage as discussed above.

In one particular embodiment, a torque profile is selected to apply a sharp rise in torque on the winch to rapidly increase tension on the anchor cable to set the anchor in the sea bed. The stored battery backup power is applied to the winch to achieve a more rapid rise in torque exerted by the winch than possible using the electric generator power by itself. In another particular embodiment, a torque profile is selected to apply a sharp rise in torque on the winch to rapidly increase tension on the anchor cable to remove the anchor from the sea bed. In another particular embodiment, a neural network is provided to monitor tension and torque applied during to the anchor cable and winch during successful anchor setting operations. The neural network stores the monitored tension and torque settings and applies the stored tension and torque settings to the winch during anchor handling operations. Anchor handling operations include but are not limited to anchor setting in the sea bed and anchor removal from the seabed. In another particular embodiment, a neural network is provided to monitor tension and torque applied during to the anchor cable and winch during successful anchor setting operations under changing acceptable stability parameters due to changes in loading of the vessel or damage to the vessel. The neural network stores the monitored tension and torque settings and applies the stored tension and torque settings to the winch during anchor handling operations.

In another particular embodiment, a neural network is provided to monitor tension and torque applied to the anchor cable and winch during successful anchor removal operations. The neural network stores the monitored tension and torque settings and applies the stored tension and torque settings to the winch during anchor handling operations. User inputs and commands to the torque processor from a vessel operator are performed using a graphical user interface (not shown) in data communication with the torque control processor.

The presently disclosed hybrid winch system 200 automatically and dynamically controls the torque of the electric winch 202 depending on the need for power and sea conditions without any manual assistance. In the case of power loss, the backup power provides for controlled release of the anchor cable 106 to keep the electric winch 202 from pulling the anchor handling vessel 114 under water without cutting the anchor cable 106 attached to the anchor 108. The hybrid winch system 200 provides additional control over setting and reclaiming the anchor 108 from the seabed.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The foregoing description of an illustrative embodiment of the present invention has been presented for the purpose of illustration and description. It is not intended to be exhaustive or to limit the invention to the precise form disclosed. Many modifications and variations are possible in light of the above teachings. Figures are also merely representational and may not be drawn to scale. Certain proportions thereof may be exaggerated, while others may be minimized. It is intended that the scope of the present invention not be limited by this detailed description, but by the claims and the equivalents to the claims appended hereto.

What is claimed is:

1. A system comprising:

an electric winch mountable on an anchor handling vessel;

an electric generator for providing generated power to the electric winch;

a battery for providing stored power to the electric winch;

an anchor cable wound around the electric winch and passing over a roller drum for guiding the anchor cable;

an anchor attached to a distal end of the anchor cable; and a winch controller for selectively applying the generated power and the stored power to the electric winch, whereby the winch controller being configured to provide the stored power to the electric winch for controlled release of the anchor cable in case of loss of the generated power;

a torque control processor;

an input/output port for connecting the electric winch to the winch controller; and a non-transitory computer readable medium in data communication with the torque control processor and comprising a computer program having executable instructions to:

determine if the electric generator power failed;

measure tension on the anchor cable attached to the electric winch and the anchor when the electric generator power has failed;

compare the tension to an acceptable stability parameter and instructions to decrease a torque of the electric winch pulling the anchor cable when the tension on the cable exceeds the acceptable stability parameters increase the torque of the electric winch pulling the anchor cable when the tension on the cable is less than the acceptable stability parameter for controlled release thereof by providing stored power from the battery.

2. The hybrid winch system of claim 1 wherein the computer program further comprises:

instructions to determine if an acceptable stability parameter of the anchor handling vessel is exceeded; and instructions to adjust the torque of the electric winch until the acceptable stability parameter is not exceeded.

3. The hybrid winch system of claim 1 wherein the computer program further comprises:

instructions to determine if a set anchor mode for the winch controller is turned on;

instructions to add controlled torque to the electric winch when the set anchor mode is turned on by providing stored power from the battery in accordance with a selected torque profile;

instructions to measure tension on the anchor cable and adjust the torque of the electric winch; and instructions to determine if the anchor is set in the sea bed.

4. The hybrid winch system of claim 1 wherein the electric winch is driven by an electric motor.

5. The hybrid winch system of claim 1 wherein the electric generator is powered by an engine of the anchor handling vessel.

6. The hybrid winch system of claim 1 wherein the battery provides backup power for the electric winch if the electric generator loses power.

7. The hybrid winch system of claim 1 wherein the battery provides extra horse power for setting the anchor in the sea bed off shore for stabilizing a floating oil rig.

8. A hybrid winch system for use with an anchor handling vessel, the system comprising:

an electric winch mountable on the anchor handling vessel;

an electric generator for providing generated power to the electric winch;

a battery for providing stored power to the electric winch;

an anchor cable wound around the electric winch and passing over a roller drum for guiding the anchor cable;

an anchor attached to a distal end of the anchor cable; and a winch controller comprising:

a torque control processor;

an input/output port for connecting the electric winch to the winch controller; and a computer program stored in a non-transitory computer readable medium in data communication with the torque control processor and comprising a computer program having executable instructions to selectively apply the generated power and the stored power to the electric winch, whereby the winch controller being configured to provide the stored power to the electric winch for controlled release of tension on the anchor cable in case of loss of the generated power wherein the computer program comprises instructions to:

compare the tension to an acceptable stability parameter and instructions to decrease a torque of the electric winch pulling the anchor cable when the tension on the cable exceeds the acceptable stability parameters and instructions to increase the torque of the electric winch pulling the anchor cable when the tension on the cable is less than the acceptable stability parameter for controlled release thereof by providing stored power from the battery.

9. The hybrid winch system of claim 8 wherein the computer program comprises executable instructions to:

determine if the electric generator power failed;

measure tension on the anchor cable attached to the electric winch and the anchor when the electric generator power has failed;

adjust torque of the electric winch pulling the anchor cable for controlled release thereof by providing stored power from the battery;

determine if acceptable stability parameters for the anchor handling vessel are exceeded; and adjust the torque of the electric winch until the acceptable stability parameters for the anchor handling vessel are not exceeded.

10. The hybrid winch system of claim 8 wherein the computer program further comprises executable instructions to:

determine if a set anchor mode of the winch controller is turned on;

add controlled torque to the electric winch when the set anchor mode is turned on by providing stored power from the battery;

measure tension on the anchor cable and adjust the torque of the electric winch; and determine if the anchor is set in the sea bed.

11. The hybrid winch system of claim 8 wherein the electric winch is driven by a hydraulic motor.

12. The hybrid winch system of claim 8 wherein the electric generator is powered by an engine of the anchor handling vessel.

13. The hybrid winch system of claim 8 wherein the battery provides backup power for the electric winch if the electric generator loses power.

14. The hybrid winch system of claim 8 wherein the battery provides extra horse power for setting the anchor in the sea bed off shore for stabilizing a floating oil rig.

15. A method for controlling a winch system associated with an anchor handling vessel by executing a computer program stored in a non-transitory computer readable medium of a torque control processor connected to an electric winch thereof, the computer program having executable instructions which when executed performs the steps of:

measuring tension on the anchor cable attached to the electric winch and the anchor when the electric generator power has failed;

comparing the tension to an acceptable stability parameter and instructions to decrease a torque of the electric winch pulling the anchor cable when the tension on the cable exceeds the acceptable stability parameters;

increasing the torque of the electric winch pulling the anchor cable when the tension on the cable is less than the acceptable stability parameter for controlled release thereof by providing stored power from the battery.

16. The method of claim 15 further comprising the steps of:

a) determining at the winch controller if a set anchor mode is turned on;

b) adding controlled torque to the electric winch when the set anchor mode is turned on by providing stored power from the battery;

c) selecting a torque profile for a current set of acceptable stability parameters;

d) applying the torque profile to the winch;

e) measuring the tension on the anchor cable and adjusting the torque of the electric winch;

f) determining if the anchor is set in the sea bed; and g) returning to step (d) if the anchor is not set.

17. The method of claim 15 wherein the electric generator is powered by an engine of the anchor handling vessel.

18. The method of claim 15 wherein the battery provides backup power for the electric winch if the electric generator loses power.

19. The method of claim 16 wherein the battery provides extra horse power for setting the anchor in the sea bed off shore for stabilizing a floating oil rig.

* * * * *